United States Patent [19]

Iturriaga-Notario

[11] 4,078,439

[45] Mar. 14, 1978

[54] ALTERNATIVE RECIPROCATING COMPRESSOR

[76] Inventor: Luis Iturriaga-Notario, Pico de los Artilleros, 160 Moratalaz, Madrid, Spain

[21] Appl. No.: 622,197

[22] Filed: Oct. 14, 1975

[30] Foreign Application Priority Data

Oct. 15, 1974 Spain ..... 206.606
Oct. 30, 1974 Spain ..... 207.055

[51] Int. Cl.[2] ..... F16H 21/16

[52] U.S. Cl. ..... 74/53; 123/56 BC; 74/25; 123/197 R

[58] Field of Search ..... 74/53, 44, 42, 571, 74/25; 123/56 BC, 56 AC, 56 C, 56, 197

[56] References Cited

U.S. PATENT DOCUMENTS

| | | | |
|---|---|---|---|
| 852,033 | 4/1907 | Phillippe | 123/56 C |
| 2,223,100 | 11/1940 | Foster | 123/56 BC |
| 2,367,963 | 1/1945 | Ricardo | 123/56 BC |
| 2,374,959 | 5/1945 | Ruppe | 123/56 BC |
| 2,513,514 | 7/1950 | Poage | 123/56 BC |
| 2,592,237 | 4/1952 | Bradley | 74/571 R |
| 2,900,839 | 8/1959 | Mackintosh | 74/571 R |

*Primary Examiner*—Samuel Scott
*Assistant Examiner*—Wesley S. Ratliff, Jr.
*Attorney, Agent, or Firm*—Ladas, Parry, Von Gehr, Goldsmith & Deschamps

[57] ABSTRACT

An alternative reciprocating compressor having a driving shaft that is solidly fastened to a circular eccentric which externally, and by means of a ball or roller bearing is enclosed by another eccentric which is also circular and is also provided at its external rim with a ball or roller bearing. The other eccentric at its outer path incorporates, at diametrically opposite points extensions to which plungers are joined, in such a way that the turn of a driving shaft originates alternate rotating slidings of one eccentric with respect to the other thus causing the successive approximation and separation of the geometrical axes pertaining to the enclosing eccentric and the driving shaft within a plane comprising the longitudinal axes of the plungers, which is converted in the claims.

3 Claims, 13 Drawing Figures

4
2
1

ALTERNATIVE RECIPROCATING COMPRESSOR

The present invention consists of an alternative reciprocating compressor from which the piston rod and crankshaft, which conventionally transformed the circular movement into alternating movement, have been eliminated, such elements, the piston rod and crankshaft, being substituted by a device comprised of a circular eccentric whereon are mounted, by means of a bearing, the pistons or plungers which will be situated in a diametrically opposed position. The eccentric will turn freely about another circular eccentric, also by means of a bearing solidly fastened to the driving shaft, in such a way that when this shaft rotates and consequently the internal eccentric, a dual movement is produced in the external eccentric; one of alternating rotation and the other of linear movement also alternating.

The plungers are permanently in contact with the eccentric, thus transforming the circular movement of the driving shaft, to which said eccentric is solidly fastened, into alternating movement. Thus compressed air, which will be stored, as usual, in a drum, is obtained.

As another mode of embodiment of the device, the possibility has been contemplated of coupling to the external eccentric two pairs of opposed pistons, arranged parallely according to the vertices of a rectangle, in such a way that the volume of air under pressure produced is multiplied by two for some determined dimensions of the cylinders.

Another mode of embodiment, which does not affect the essence of the invention, consists in fitting the eccentric into the interior of a bearing, adjusted to the inner path thereof. Externally said bearing is installed in combination with a gib-like member comprising two parallel panels between which the bearing is adjusted in such a way that it can slide along a certain length with respect to said gib.

The parallel panels of said gib project outwards, forming extensions, in each one of which there is a hole for the coupling therein of the pin of the piston or plunger.

The displacement of the gib, as a result of the turn of the eccentric transmitted to the bearing, will be equal to the value of the eccentricity of the eccentric member, with respect to the shaft which stems, for example, from an electromotor, which will be the force or power used to make the plungers move through this impeller device.

It has also been contemplated that instead of a mere pair of opposed pistons, the compressor in question should be poly-cylindrical, but in any case, the plungers would preferably be arranged in pairs and in opposition.

The device can likewise be considered as a modular element, capable of being coupled parallel with others and on the same shaft, thus concentrating the power obtained according to the desired factor.

The attached drawings represent sketches of the various modes of embodiment or variants as well as their functional phases.

Figure 3:
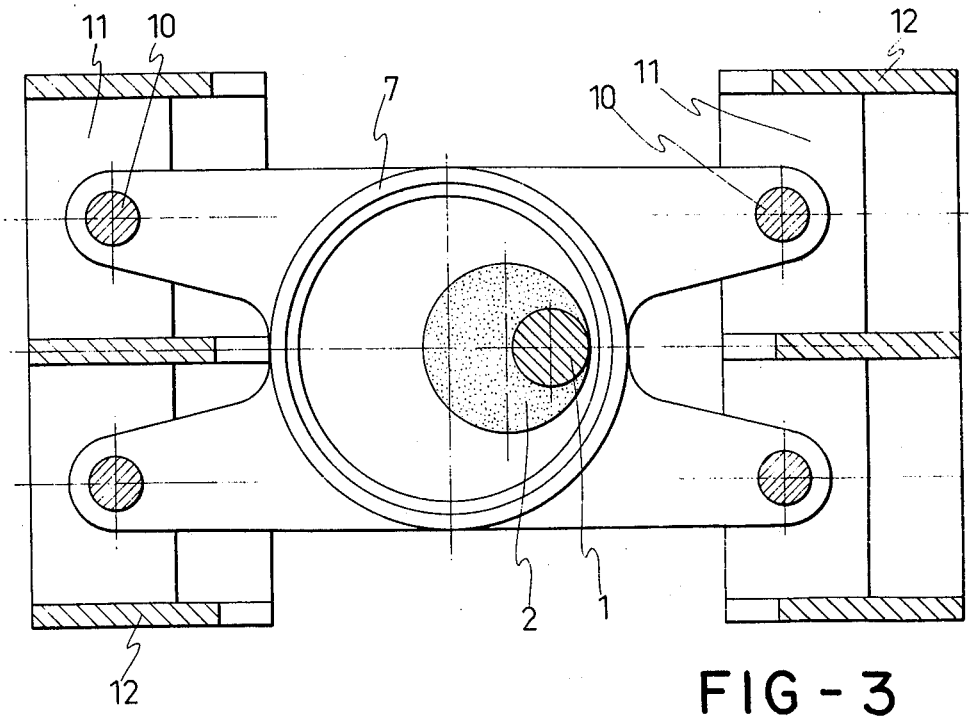

FIG. 3 refers to the mode of embodiment wherein two pairs of opposed plungers are coupled to the external eccentric.

Figure 4:
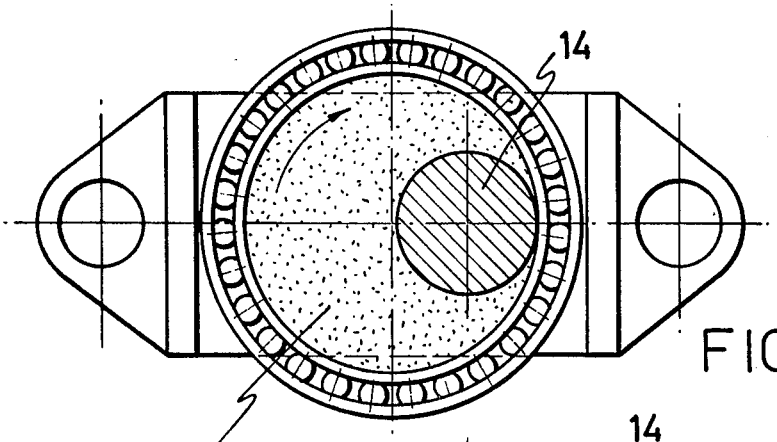
Figure 5:
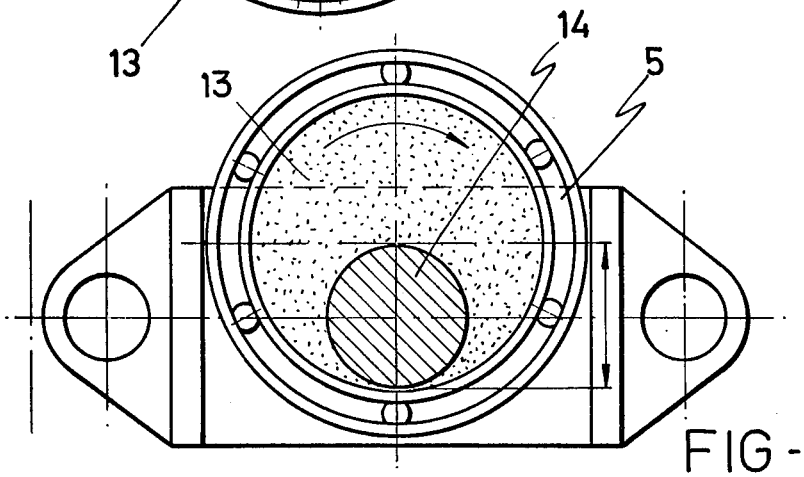
Figure 6:
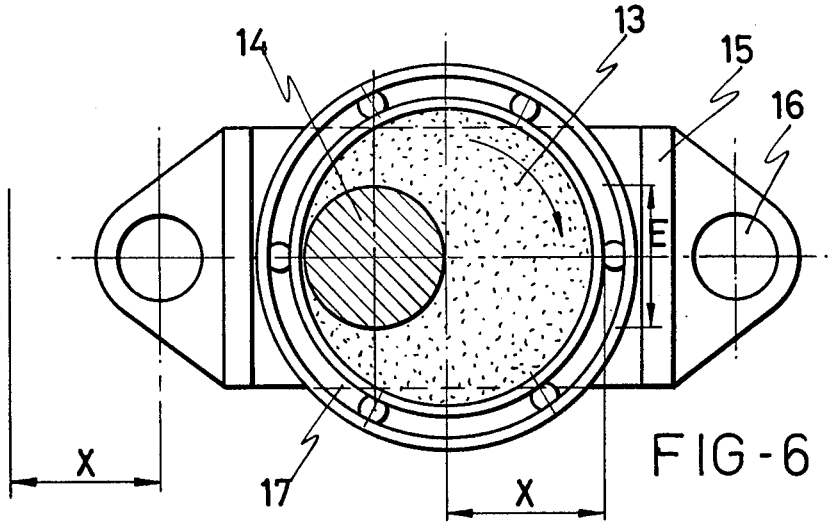

FIGS. 4, 5 and 6 illustrate sketches of other functional phases of the device which incorporates a gib to which the eccentric is slidably mounted.

Figure 7:
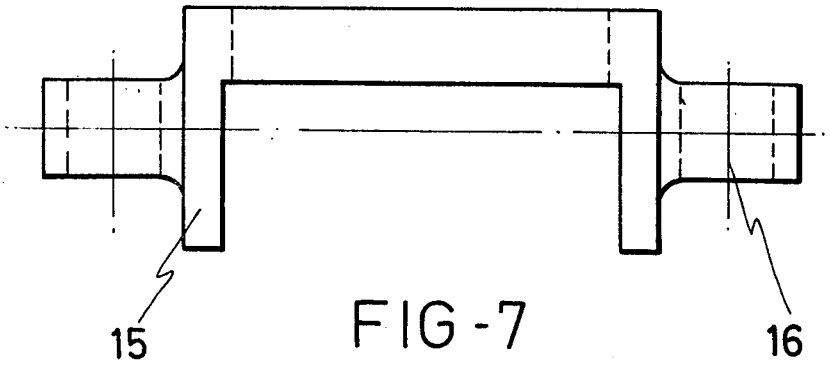

FIG. 7 represents the gib according to a plan view.

Figure 8:
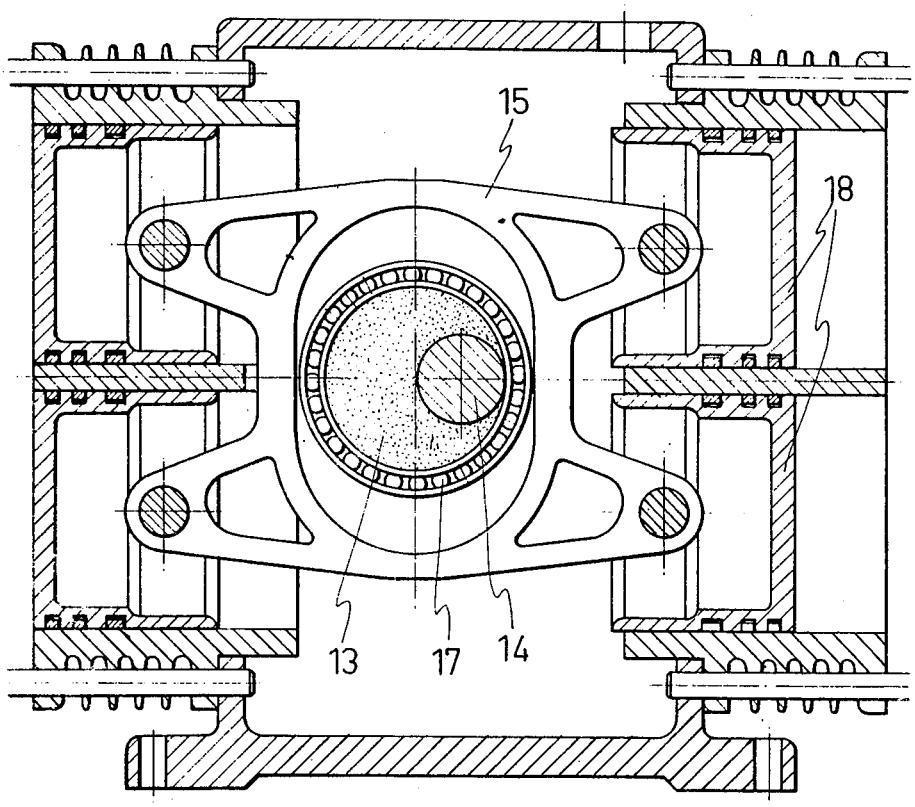

FIG. 8 represents another type of compressor, which having the specific characteristics of the compressor illustrated in FIGS. 4, 5 and 6, has four plungers, in opposed pairs.

Figure 1:
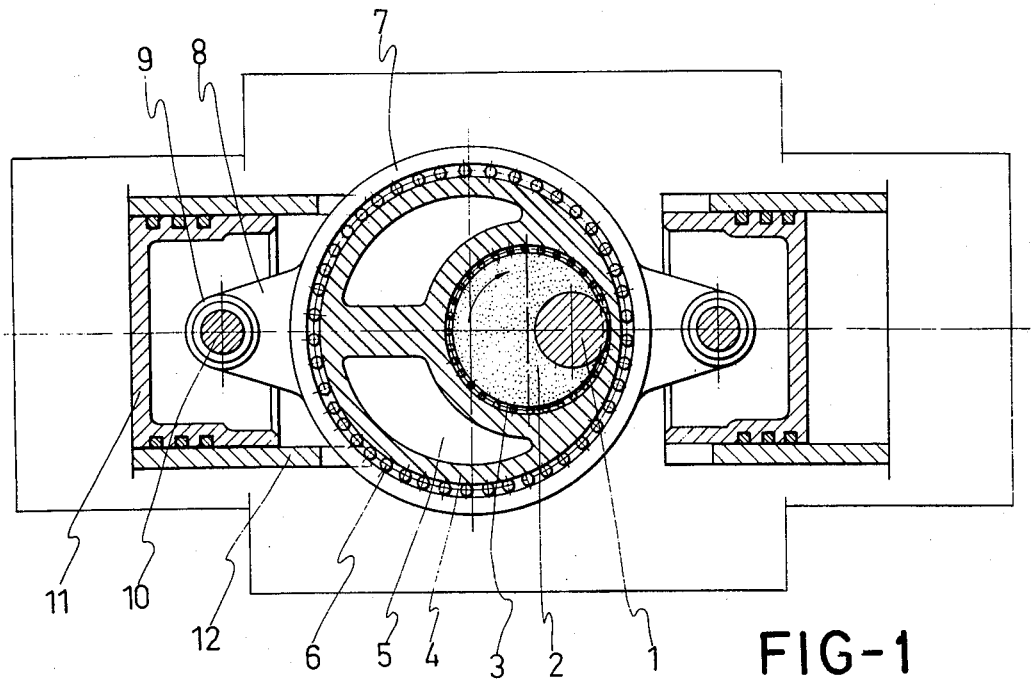
FIG. 1 represents a cross-sectional view of the device, object of the invention, wherein the arrangement of the eccentrics, constituting the transmission mechanism of the movement, in one of its possible modes of embodiment, can be exactly seen.
Figures 2A, 2B, 2C, 2D, 2E, 2F:
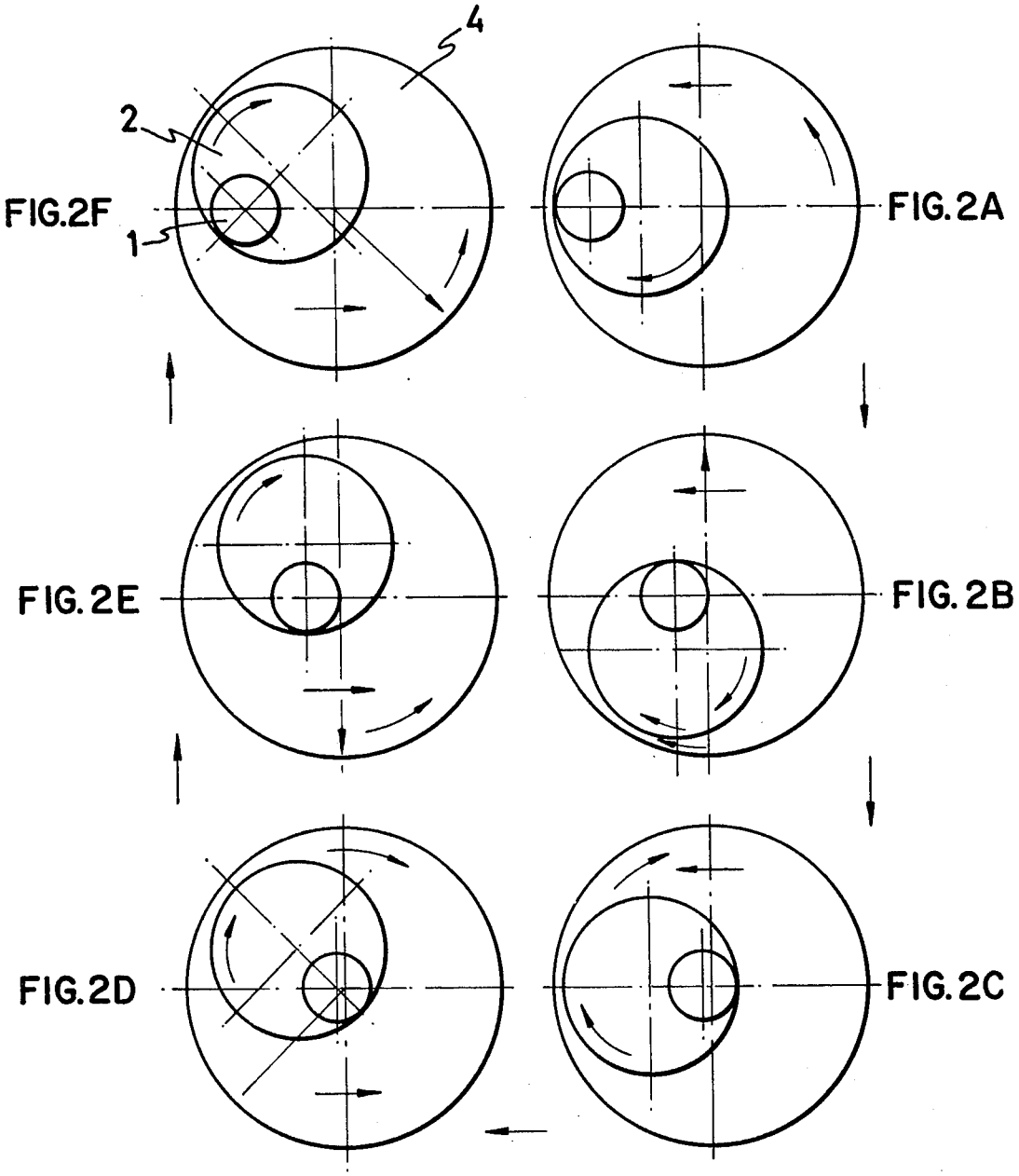
FIG. 2 illustrates six positions corresponding to a complete cycle of the driving shaft, with the various intermediate positions and rotating directions of the eccentrics, the various positions being arranged according to the rotating direction of the needles of a watch.

It can be seen from FIGS. 1, 2 and 3 that the driving shaft 1 is rigidly connected to a circular eccentric 2 on which, through a bearing 3, a second circular eccentric 4 is mounted.

This external eccentric 4, provided with cutouts 5 to lighten its weight, is connected through a second bearing 6 to a cylindrical casing 7 which is diametrically extended into two lugs 8 which, ending in bushings 9, is connected by means of the pins 10 to the pistons 11 which are housed in the cylinders 12.

Under such conditions, when the driving shaft 1, and consequently the eccentric 2, rotate a movement is produced in the eccentric 4 which is connected to the cylinders by means of the pistons, and since the cylinders are fixed, it can only be displaced according to a shaft which joins the mentioned cylinders, adopting a rotating and linear displacing interconnected movement. If a complete cycle is analyzed departing from the position A of FIG. 2, it can be seen that when the driving shaft 1 rotates to the right, the external eccentric 4 should forcedly rotate in the opposite direction since it cannot be displaced downwards, but it is at the same time displaced to the left.

When position B is reached, the external eccentric 4 continues being displaced towards the left but it inverts its turning direction accompanying the inner eccentric 2 and, therefore, the driving shaft 1 in its turn to the right. Position C conserves the movements of the former. Position D corresponds to the displacing limit towards the left of the external eccentric 4, commencing at this moment its displacement to the right, but continuing with the same turning direction as the internal eccentric 2.

Position E maintains the linear displacement towards the right, but the turning direction of the external eccentric 4 is inverted therein, turning in the opposite direction to that of the driving shaft 1.

These same movements are conserved in the position F whereat the turning cycle ends so as to again pass to position A.

As can be seen from these phases of the movement, the center of the driving shaft 1 approaches the geometrical center of the external circular eccentric 4 to be subsequently separated therefrom, without having been reached same, which position can never be reached since, if these two centers were to coincide, the eccentric 4 would no longer be such with respect to the shaft 1 and it would turn in a circular manner without linear displacements.

It can be cited, as a rather great advantage, the fact that, as can be seen from the movements reflected in FIG. 2, the end zones of the linear displacements, that is to say when the piston should effect a greater force since it is situated in the maximum compression zone, correspond to smaller displacement zones with regard to the turning magnitude, which implies the ability of using a lesser power applied to the driving shaft, to obtain the same yield.

Referring to the embodiment illustrated in FIGS. 4 to 8, reference 13 indicates the eccentric which is solidly fastened to the shaft 14 which will be the primary driving spindle. It can be seen that such eccentric 13 is fitted into the interior of a bearing referenced 17, which is coupled externally between the legs 15 of a gib-like member, with respect to which it can be displaced due to the turn of the eccentric, according to the direction of the arrows indicated in FIGS. 4, 5 and 6.

The legs 15 of the gib are parallel to each other and are spaced in a distance approximately equal to that of the diameter of the bearing 17, with the necessary allowances for the assembly between both elements.

Edgewise, the gib has lugs provided with panels 16 for the passage of the pins which should anchor the plungers or pistons of the compressor.

The eccentricity which is reflected with the letter X will be the displacement effected by the gib in a horizontal direction when the driving element makes a turn, bearing in mind that the same measure X will be the swinging movement in a vertical direction of the bearing 17, but with the feature that there will be no small blows or sharp blows, precisely due to the adjustment of such bearing between the legs 15 of the gib which, on the other hand, is closely related to the opposed pistons which, as previously mentioned, could be of four, as clearly illustrated in FIG. 8.

The maximum vertical displacement of the bearing, for example upwards, as illustrated in FIG. 5, will coincide with the maximum lower position of the shaft 14 or driving spindle.

I claim:

1. An alternative reciprocating compressor having at least a pair of plungers or pistons diametrically opposed and operating in reciprocal fashion comprising a driving shaft which is affixed to a circular eccentric, said circular eccentric being externally enclosed by an enclosing eccentric, both said eccentrics having ball or roller bearings located at their external edges, said enclosing eccentric being contained in a substantially cylindrical case which has at diametrically opposite points extensions to which the plungers are joined, the driving shaft being affixed to said circular eccentric with their respective longitudinal axes spaced, said circular eccentric being disposed in said enclosing eccentric with their respective longitudinal axes spaced, such that rotation in one direction of the driving shaft causes the enclosing eccentric to rotate in alternate directions thereby causing the successive approximation and separation of the longitudinal axes of the enclosing eccentric and the driving shaft within a plane comprising the longitudinal axis of the plungers, which imparts a reciprocating movement to said plungers.

2. An alternative reciprocating compressor according to claim 1, wherein the longitudinal axis of the enclosing eccentric moves towards the longitudinal axis of the driving shaft during half a complete revolution of the driving shaft and thereafter moves away therefrom during a second half of a complete revolution, said geometric centers approaching one another without ever overlapping.

3. An alternative reciprocating compressor according to claim 1, wherein the enclosing eccentric rotates in the same direction as the circular eccentric during half a revolution of the driving shaft.

* * * * *